US010566693B2

(12) United States Patent
Tsai et al.

(10) Patent No.: US 10,566,693 B2
(45) Date of Patent: Feb. 18, 2020

(54) THREE-DIMENSION BUTLER MATRIX

(71) Applicant: Industrial Technology Research Institute, Hsinchu (TW)

(72) Inventors: Zuo-Min Tsai, Miaoli County (TW); Cheng-Hung Hsieh, Nantou County (TW)

(73) Assignee: Industrial Technology Research Institute, Hsinchu (TW)

( * ) Notice: Subject to any disclaimer, the term of this patent is extended or adjusted under 35 U.S.C. 154(b) by 336 days.

(21) Appl. No.: 15/800,090

(22) Filed: Nov. 1, 2017

(65) Prior Publication Data

US 2018/0337453 A1 Nov. 22, 2018

(30) Foreign Application Priority Data

May 16, 2017 (TW) ..... 106116050 A

(51) Int. Cl.
*H01Q 3/40* (2006.01)
*H01P 5/12* (2006.01)

(52) U.S. Cl.
CPC ..... *H01Q 3/40* (2013.01); *H01P 5/12* (2013.01)

(58) Field of Classification Search
CPC ..... H01Q 3/40; H01Q 3/26; H01Q 25/00; H01Q 25/02; H01Q 1/246
USPC ..... 342/373
See application file for complete search history.

(56) References Cited

U.S. PATENT DOCUMENTS 4,316,192 A 2/1982 Acoraci
4,356,461 A 10/1982 Acoraci
6,703,982 B2 3/2004 Park
8,013,784 B2 9/2011 Margomenos
8,766,851 B2 7/2014 Lee et al.
8,797,122 B2 8/2014 Lee et al.
2004/0028336 A1* 2/2004 Feuer ..... G02B 6/12 385/50
2010/0225539 A1* 9/2010 Margomenos ..... G01S 7/032 342/373
2012/0112963 A1* 5/2012 Lee ..... H01P 5/12 342/373
2013/0229308 A1 9/2013 Pu et al.

FOREIGN PATENT DOCUMENTS

CN 103022701 4/2013
TW I244799 12/2005
TW I278145 4/2007
TW 201131893 9/2011

(Continued)

OTHER PUBLICATIONS

"Notice of Allowance of Taiwan Counterpart Application," dated Jun. 19, 2018, p. 1-p. 3.

(Continued)

*Primary Examiner* — Harry K Liu
(74) *Attorney, Agent, or Firm* — JCIPRNET

(57) ABSTRACT

The disclosure provides a Butler Matrix. The Butler Matrix includes: a plurality of couplers having a circuit of a cuboid structure, a plurality of crossover lines, a plurality of three-dimensional crossover lines having a three-dimensional structure, and a plurality of phase shifters. The phase shifters, the crossover lines, and the three-dimension crossover lines are been coupled between one of the couplers and the other of the couplers.

17 Claims, 16 Drawing Sheets

(56) References Cited

FOREIGN PATENT DOCUMENTS

| | | |
|---|---|---|
| TW | M432958 | 7/2012 |
| TW | M460422 | 8/2013 |
| TW | M465678 | 11/2013 |
| TW | I517499 | 1/2016 |

OTHER PUBLICATIONS

L. Baggen, et al., "3D-Butler matrix topologies for phased arrays," ICEAA 2007. International Conference on Electromagnetics in Advanced Applications, Sep. 17-21, 2007, pp. 531-534.
Yi-Che Tsai, et al., "Based on Two Dynamically Beam-Forming Capabilities in a 2D Phased Array Antenna System," 2015 International Workshop on Electromagnetics: Applications and Student Innovation Competition (iWEM), Nov. 16-18, 2015, pp. 1-2.
Rafael D. Cerna, et al., "Design and Implementation of a Wideband 8x8 Butler Matrix for AWS and PCS 1900 MHz Beamforming Networks," 2015 IEEE International Wireless Symposium (IWS), Mar. 30-Apr. 1, 2015, pp. 1-4.
Abdulrahman Alaqeel, et al., "Broadband 4 x 4 Butler Matrix for K- and Ka- Bands," 2015 IEEE International Symposium on Antennas and Propagation & USNC/URSI National Radio Science Meeting, Jul. 19-24, 2015, pp. 230-231.
Wei-Yang Chen, et al., "A Compact Two-Dimensional Phased Array Using Grounded Coplanar-Waveguides Butler Matrices," Proceedings of the 42nd European Microwave Conference, Oct. 29-Nov. 1, 2012, pp. 747-750.
Wei-Yang Chen, et al., "A 60-GHz CMOS 16-Beam Beamformer for Two-Dimensional Array Antennas," 2014 IEEE MTT-S International Microwave Symposium (IMS), Jun. 1-6, 2014, pp. 1-3.
William F. Moulder, et al., "60-GHz Two-Dimensionally Scanning Array Employing Wideband Planar Switched Beam Network," IEEE Antennas and Wireless Propagation Letters, vol. 9, Aug. 26, 2010, pp. 818-821.
Chun-Hong Chen, et al., "Implementation of a Low-loss Wide-band Flat-topped Beam-forming Network Based on Butler Martix," 2015 Asia-Pacific Microwave Conference (APMC), Dec. 6-9, 2015, pp. 1-3.
A. Moscoso-Mártir, et al., "Wideband Slot-Coupled Butler Matrix," IEEE Microwave and Wireless Components Letters, vol. 24, No. 12, Dec. 2014, pp. 848-850.
Kejia Ding, et al., "A Compact 8x8 Butler Matrix Based on Double-layer Structure," 2013 IEEE 5th International Symposium on Microwave, Antenna, Propagation and EMC Technologies for Wireless Communications (MAPE), Oct. 29-31, 2013, pp. 650-653.
Erio Gandini, et al., "A Lumped-Element Unit Cell for Beam-Forming Networks and Its Application to a Miniaturized Butler Matrix," IEEE Transactions on Microwave Theory and Techniques, vol. 61, No. 4, Apr. 2013, pp. 1477-1487.
Ge Tian, et al., "A Novel Compact Butler Matrix Without Phase Shifter," IEEE Microwave and Wireless Components Letters, vol. 24, No. 5, May 2014, pp. 306-308.

* cited by examiner

THREE-DIMENSION BUTLER MATRIX

CROSS-REFERENCE TO RELATED APPLICATION

This application claims the priority benefit of Taiwan application serial no. 106116050, filed on May 16, 2017. The entirety of the above-mentioned patent application is hereby incorporated by reference herein and made a part of this specification.

TECHNICAL FIELD

The disclosure relates to a three-dimensional Butler Matrix.

BACKGROUND

Despite the development of science and technology, further efforts are still required in the wireless communication technologies relating to millimeter wave (mmWave). In general, the first challenge is that the wave energy may be significantly attenuated during transmission of the mmWave. The attenuation is closely related to the high frequency band at which a mmWave communication system operates and a rather large bandwidth required for communication in the mmWave communication system. More specifically, compared with the third generation (3G) or the fourth generation (4G) communication system commonly used nowadays, the mmWave communication system adopts a relatively higher frequency band for communication. It is known that an intensity of an electromagnetic wave energy received by a receiver is negatively proportional to a square of a signal transmission distance and is positively proportional to a wavelength of an electromagnetic signal. Therefore, the degree to which the signal energy of the mmWave communication system attenuates is significantly increased because of the high frequency signal with a shorter wavelength adopted in the mmWave communication system. In addition, the use of the high frequency signal also results in a drastic decrease in antenna aperture, and may also result in a decrease in the signal energy for signal transmission in the mmWave communication system. Therefore, to ensure the communication quality, a transceiver in the mmWave communication system normally requires a multi-antenna beamforming technology to reduce signal energy attenuation and thus facilitate the performance of signal transmission and reception.

Generally speaking, the multi-antenna beamforming technology includes arranging an antenna array including a plurality of antennas in a base station/user apparatus and controlling the antennas so that the base station/user apparatus may generate a directional beam. The beamforming technology achieved with the antenna array is crucial to the performance of the mmWave communication system. It is common to adopt a Butler Matrix to control beamformed signals of an antenna array. However, the Butler Matrix is only able to control the directionality of beams in a two-dimensional space, such as controlling a horizontal direction of the beamformed signals. However, a Butler Matrix only capable of controlling the horizontal direction is insufficient for a case where a transmitting end has a difference in height, for example.

SUMMARY

The disclosure provides a Butler Matrix. The Butler Matrix includes: a plurality of couplers having a circuit of a cuboid structure, a plurality of crossover lines, a plurality of three-dimensional crossover lines having a three-dimensional structure, and a plurality of phase shifters. The crossover lines, the three-dimensional crossover lines, and the phase shifters are coupled between one of the couplers and another of the couplers.

Several exemplary embodiments accompanied with figures are described in detail below to further describe the disclosure in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DETAILED DESCRIPTION OF DISCLOSED EMBODIMENTS

Based on the above, in addition to simultaneously controlling the horizontal direction and the vertical direction of the beam, the Butler Matrix of the disclosure can be manufactured with only a manufacturing process of a single multi-layer circuit board. Thus, the size and the manufacturing cost of the Butler Matrix are able to be reduced significantly.

Figure 1A:
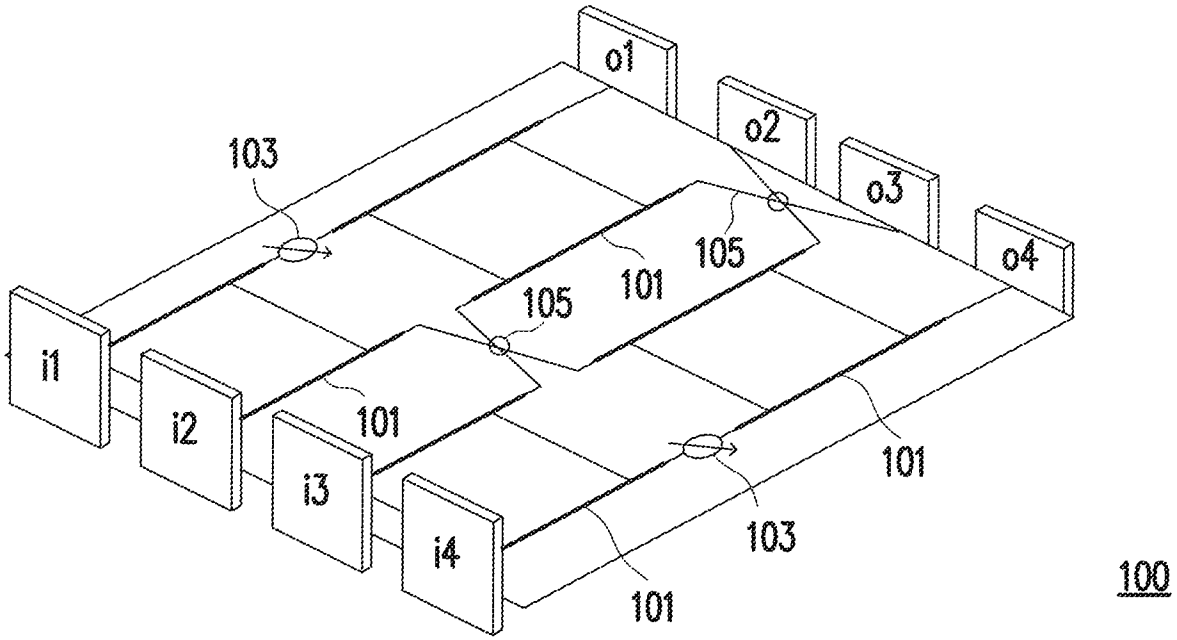
FIG. 1A is a schematic view illustrating a Butler Matrix.

FIG. 1A is a schematic view illustrating a Butler Matrix 100. A way for controlling beamformed signals of an antenna array with a Butler Matrix is common in the related field. The Butler Matrix 100 of FIG. 1A has four input ends and four output ends, and the Butler Matrix 100 includes a plurality of couplers 101, a plurality of phase shifters 103, and a plurality of crossover lines 105. Input ends i1, i2, i3, and i4 are respectively coupled to a plurality of output ends o1, o2, p3, and o4. When a signal is input from different input ends, the signal may generate different phase differences at different output ends. Taking the input ends i1 and i2 as an example, since the phase differences between the input ends i1 and i2 and the output ends o1, o2, o3, and o4 are respectively different, beamformed signals having different phase differences and directional properties may be generated when a signal is input from the input end i1 or from the input end i2.

The Butler Matrix shown in FIG. 1A is only able to adjust a beamformed signal in a horizontal direction. However, when a receiving end of the beamformed signal has a height difference, the Butler Matrix only capable of controlling the horizontal direction is insufficient to handle such case. Therefore, a Butler Matrix capable of controlling a horizontal direction as well as a vertical direction of a beam is required.

Figure 1B:
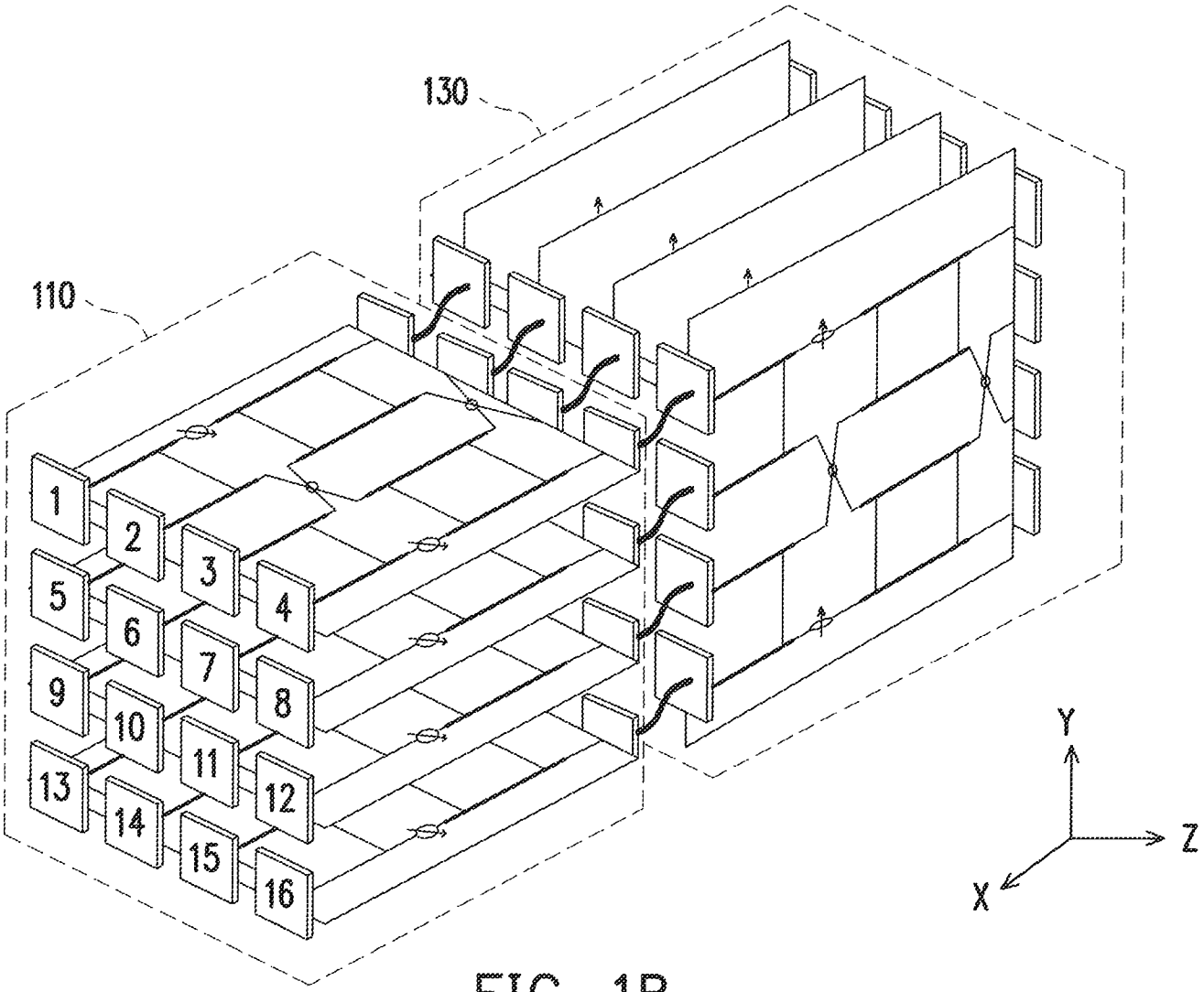
FIG. 1B is a schematic view illustrating combining two-dimensional Butler Matrices controlling horizontal and vertical directions of a beam.

FIG. 1B is a schematic view illustrating combining two-dimensional Butler Matrices controlling the horizontal and vertical directions of a beam. The Butler Matrix of FIG. 1B is formed by a plurality of the Butler Matrices 100. A left half 110 of FIG. 1B is formed by stacking four Butler Matrices 100 arranged horizontally, and a right half 130 of FIG. 1B is formed by stacking four Butler Matrices 100 arranged vertically. The Butler Matrices of FIG. 1B are capable of controlling a beam two-dimensionally. For example, a signal input from an input end 1 and a signal input from an input end 2 may render two beams in different horizontal directions, and a signal input from the input end 1 and a signal input from an input end 5 may render two beams in different vertical directions. While the Butler Matrices of FIG. 1B are able of controlling a beam two-dimensionally, the configuration shown in FIG. 1B requires a set of Butler Matrices stacked horizontally and a set of Butler Matrices stacked vertically. Therefore, the configuration has a larger size as well as a higher manufacturing cost.

Figure 2A:
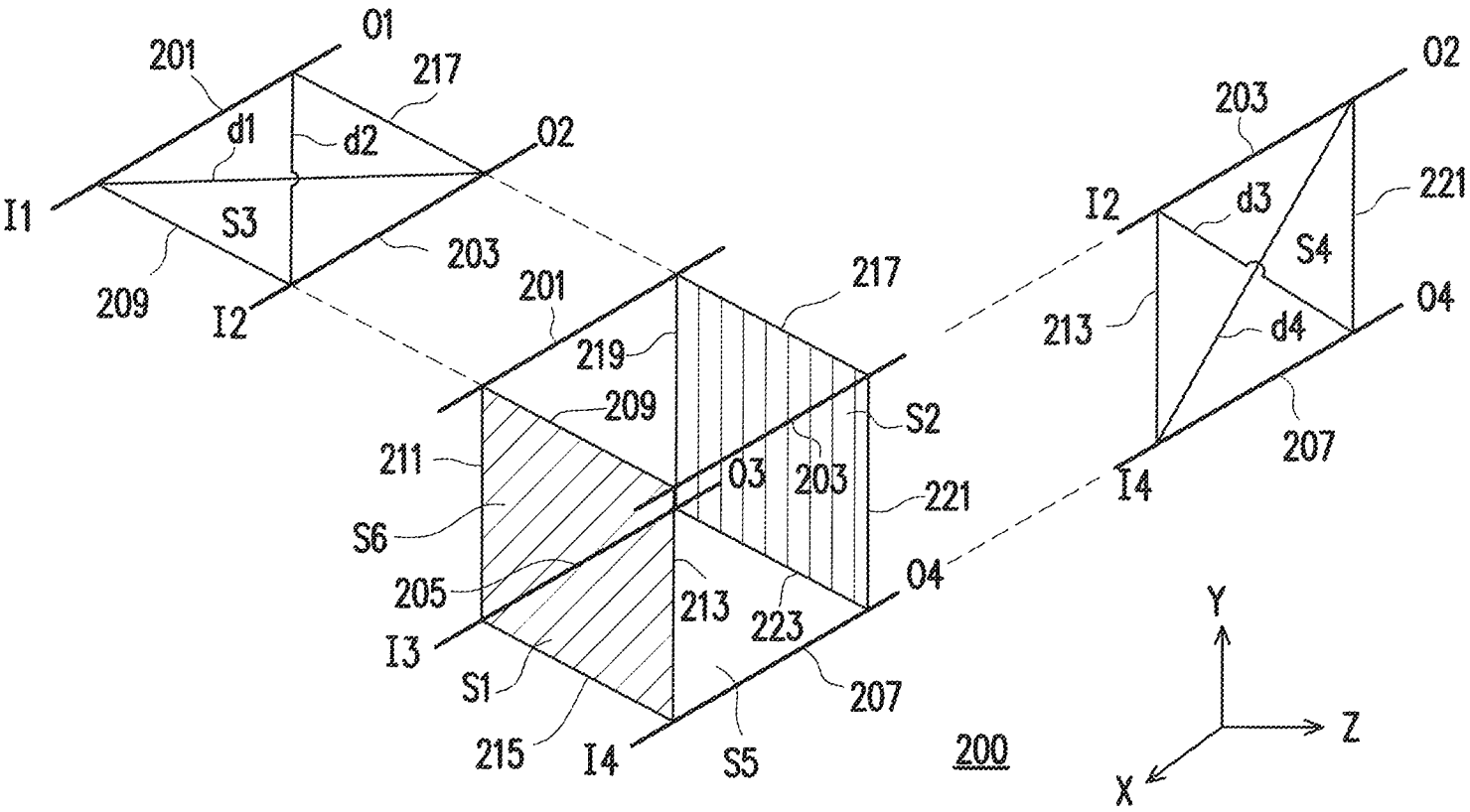
FIG. 2A is a schematic view illustrating a three-dimensional coupler according to an embodiment of the disclosure.

FIG. 2A is a schematic view illustrating a three-dimensional coupler 200 according to an embodiment of the disclosure. The three-dimensional coupler 200 has a circuit of a cuboid structure, and the three-dimensional coupler 200 may include a first input end I1, a second input end I2, a third input end I3, and a fourth input end I4 forming a first surface S1 of the cuboid structure. In addition, the three-dimensional coupler 200 may also include a first output end O1, a second output end O2, a third output end O3, and a fourth output end O4 forming a second surface S2 of the cuboid structure. The first surface S1 and the second surface S2 do not intersect with each other. An $m^{th}$ input end and an $m^{th}$ output end of the three-dimensional coupler 200 form a side of the cuboid structure, wherein m is a positive integer less than or equal to 4. Specifically, the first input end I1 and the first output end O1, the second input end I2 and the second output end O2, the third input end I3 and the third output end O3, and the fourth input end I4 and the fourth output end O4 respectively form a side 201, a side 203, a side 205, and a side 207 of the cuboid structure. In an embodiment, in the cuboid structure of the three-dimensional coupler 200, each surface except for the first surface S1 and the second surface S2 may be implemented to be a two-dimensional quadrature hybrid coupler, for example. However, it should be noted that the disclosure is not limited thereto.

The respective input ends of the three-dimensional coupler 200 are insulated from each other, and the respective output ends are also insulated from each other. Therefore, for the input ends, sides 209, 211, 213, and 215 of the cuboid structure may be considered as being formed as insulators, and for the output ends, sides 217, 219, 221, and 223 may be considered as being formed as insulators.

In the cuboid structure of the three-dimensional coupler 200, there is a phase difference θ between an input end and an output end on a diagonal of the same surface of the cuboid structure. Taking a third surface S3 as an example, the surface S3 is formed by the input ends I1 and I2 and the output ends O1 and O2. In addition, the input end I1 and the output end O2 are on a diagonal d1 of the surface S3. Thus, there is the phase difference θ between the input end I1 and the output end O2. Similarly, since the input end I2 and the output end O1 are on a diagonal d2 of the surface S3, there is also the phase difference θ between the input end I2 and the output end O1. Comparatively, since the input end I1 and the output end O1 are not on a diagonal of the surface S3, there is no phase difference between the input end I1 and the output end O1. Taking a fourth surface S4 as another example, on the surface S4, there is the phase difference θ between the input end I2 and the output end O4, and there is also the phase difference θ between the input end I4 and the output end O2. In an embodiment, the phase difference θ may be 90 degrees. However, the disclosure is not limited thereto.

Figure 2B:
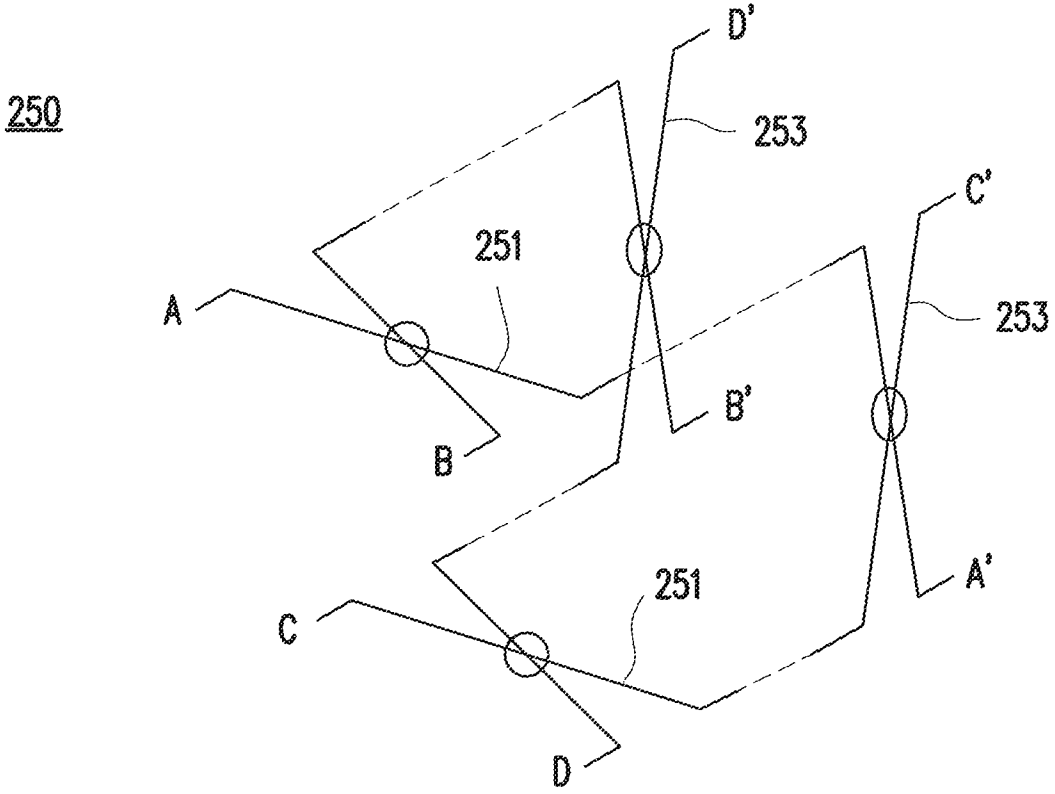
FIG. 2B is a schematic view illustrating a three-dimensional crossover line according to an embodiment of the disclosure.

FIG. 2B is a schematic view illustrating a three-dimensional crossover line 250 according to an embodiment of the disclosure. The three-dimensional crossover line 250 is formed by two horizontally arranged crossover lines 251 and two vertically arranged crossover lines 253. An input end A of the three-dimensional crossover line 250 is coupled to an output end A', an input end B is coupled to an output end B', an input end C is coupled to an output end C', and an input end D is coupled to the output end D'.

Figure 3A:
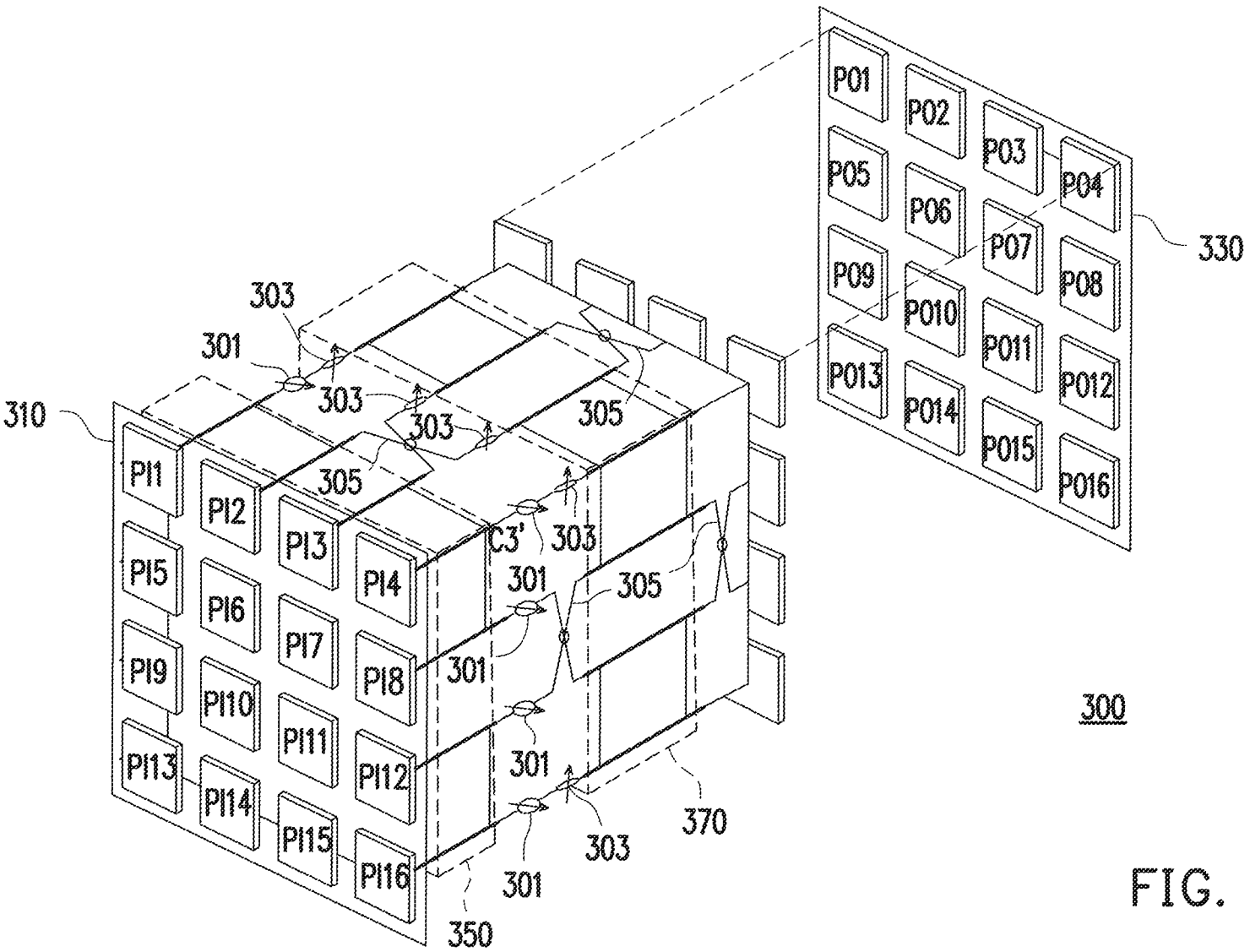
FIG. 3A is a schematic view illustrating a three-dimensional Butler Matrix according to an embodiment of the disclosure.

FIG. 3A is a schematic view illustrating a three-dimensional Butler Matrix 300 according to an embodiment of the disclosure. The Butler Matrix 300 may be formed by a first coupler set 350 and a second coupler set 370. The first coupler set 350 at least has four three-dimensional couplers 200, respectively corresponding to a three-dimensional coupler C1, a three-dimensional coupler C2, a three-dimensional coupler C3, and a three-dimensional coupler C4 shown in FIG. 3B. The second coupler set 370 at least has four three-dimensional couplers 200, respectively corresponding to a three-dimensional coupler C1', a three-dimensional coupler C2', a three-dimensional coupler C3', and a three-dimensional coupler C4' shown in FIG. 3B.

The first surfaces S1 of the respective couplers 200 in the first coupler set 350 may form an input array, and respective sides of the input array have the same number of input ends. In the embodiment, the first surfaces S1 of the three-dimensional coupler C1, the three-dimensional coupler C2, the three-dimensional coupler C3, and the three-dimensional coupler C4 form a four-by-four input array 310 having 16 input ends respectively represented as input ends PI1 to PI16. For example, the four input ends I1, I2, I3, and I4 of the three-dimensional coupler C1 may respectively form the input ends PI1, PI2, PI5 and PI6 of the four-by-four input array 310.

The second surfaces S2 of the respective couplers 200 in the second coupler set 370 may form an output array, and respective sides of the output array have the same number of output ends. In the embodiment, the second surfaces S2 of the three-dimensional coupler C1', the three-dimensional coupler C2', the three-dimensional coupler C3', and the three-dimensional coupler C4' form a four-by-four output array 330 having 16 output ends respectively represented as output ends PO1 to PO16. For example, the four output ends O1, O2, O3, and O4 of the three-dimensional coupler C may respectively form the output ends PO1, PO2, PO5 and PO6 of the four-by-four output array 330.

When the three-dimensional Butler Matrix 300 is used, at least one input end of at least one of the three-dimensional couplers 200 of the first coupler set 350 is coupled to the respective output ends of the respective three-dimensional couplers 200 of the second coupler set 370, so as to output beamformed signals corresponding to the input end from the respective output ends. For example, assuming that an input signal s is input into the three-dimensional Butler Matrix 300 through the input end PI1, the input signal s may be transmitted to the respective output ends PO1 to PO16 via a plurality of different paths. Therefore, a plurality of output signals corresponding to the respective output ends PO1 to PO16 may be turned into the input signals s having different phase differences, and beamformed signals formed by the output signals of the respective output ends PO1 to PO16 are thus directional due to the phase differences of different output signals.

In the input array 310, the beamformed signals corresponding to the input ends on the same row have phase differences in different horizontal directions. For example, an output beam obtained by inputting the signal s from the input end PI1 has a different horizontal direction than the horizontal direction of an output beam obtained by inputting the signal s from the input end PI2. In addition, the corresponding beamformed signals of the input ends on the same column have phase differences in different vertical directions. For example, an output beam obtained by inputting the signal s from the input end PI1 has a different vertical direction than the vertical direction of an output beam obtained by inputting the signal s from the input end PI5.

Figure 3B:
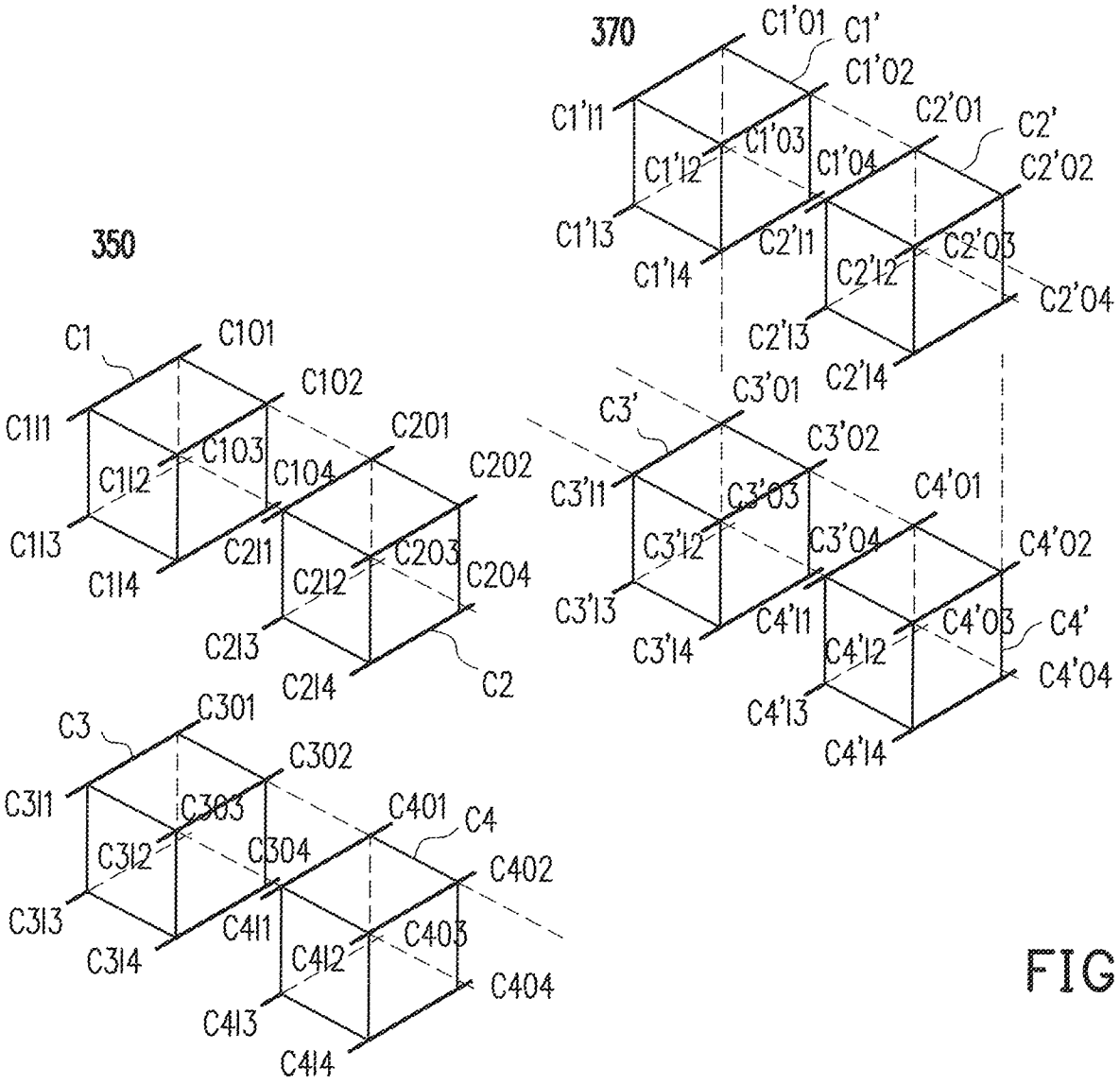
FIG. 3B is a schematic view illustrating the three-dimensional Butler Matrix in the embodiment shown in FIG. 3A in greater detail.

FIG. 3B is a schematic view illustrating the three-dimensional Butler Matrix 300 in the embodiment shown in FIG. 3A in greater detail. In the three-dimensional Butler Matrix 300, a $j^{th}$ output end of an $i^{th}$ coupler in the first coupler set 350 is coupled to an $i^{th}$ input end of a $j^{th}$ coupler of the second coupler set 370, wherein i and j are positive integers, j is less than or equal to 4, i is less than or equal to N, and N is a positive integer that is a power of 4 or more.

Specifically, a first output end c1O1, a second output end c1O2, a third output end c1O3, and a fourth output end c1O4 of a three-dimensional coupler c1 of the first coupler set 350 are respectively and sequentially coupled to a first input end c1'I1 of a three-dimensional coupler c1', a first input end c2'I1 of a three-dimensional coupler c2', a first input end c3'I1 of a three-dimensional coupler c3', and a first input end c4'I1 of a three-dimensional coupler c4' of the second coupler set 370.

A first output end c2O1, a second output end c2O2, a third output end c2O3, and a fourth output end c2O4 of a three-dimensional coupler c2 of the first coupler set 350 are respectively and sequentially coupled to a second input end c1'I2 of the three-dimensional coupler c1', a second input end c2'I2 of the three-dimensional coupler c2', a second input end c3'I2 of the three-dimensional coupler c3', and a second input end c4'I2 of the three-dimensional coupler c4' of the second coupler set 370.

A first output end c3O1, a second output end c3O2, a third output end c3O3, and a fourth output end c3O4 of a three-dimensional coupler c3 of the first coupler set 350 are respectively and sequentially coupled to a third input end c1'I3 of the three-dimensional coupler c1', a third input end c2'I3 of the three-dimensional coupler c2', a third input end c3'I3 of the three-dimensional coupler c3', and a third input end c4'I3 of the three-dimensional coupler c4' of the second coupler set 370.

A first output end c4O1, a second output end c4O2, a third output end c4O3, and a fourth output end c4O4 of a three-dimensional coupler c4 of the first coupler set 350 are respectively and sequentially coupled to a fourth input end c1'I4 of the three-dimensional coupler c1', a fourth input end c2'I4 of the three-dimensional coupler c2', a fourth input end c3'I4 of the three-dimensional coupler c3', and a fourth input end c4'I4 of the three-dimensional coupler c4' of the second coupler set 370.

In the embodiment, the numbers of the couplers 200 of the first coupler set 350 and the second coupler set 370 in the three-dimensional Butler Matrix 300 are both 4. In other words, the three-dimensional Butler Matrix 300 has 16 inputs and 16 outputs. Still, people having ordinary skills in the art shall appreciate that the framework of the disclosure may also be implemented in a three-dimensional Butler Matrix whose numbers of inputs and outputs are greater than 16 based on the three-dimensional Butler Matrix 300 of the disclosure. For example, the numbers N of the couplers 200 in the first coupler set 350 and the second coupler set 370 in the three-dimensional Butler Matrix 300 may also be positive integers that are a power of 4 or more.

In an embodiment of the three-dimensional Butler Matrix 300, which includes a plurality of couplers having a circuit of a cuboid structure, a plurality of crossover lines, a plurality of three-dimensional crossover lines having a three-dimensional structure, and a plurality of phase shifters. The crossover lines, the three-dimensional crossover lines, and the phase shifters are coupled between one of the couplers and another of the couplers. The connections between the respective terminals in the respective three-dimensional couplers are described in Table 1. Table 1 lists combinations of electrically connected terminals between the respective three-dimensional couplers 200.

TABLE 1

| Terminal 1 | Terminal 2 |
|---|---|
| C1O1 | C1'I1 |
| C1O2 | C2'I1 |
| C1O3 | C3'I1 |
| C1O4 | C4'I1 |
| C2O1 | C1'I2 |
| C2O2 | C2'I2 |
| C2O3 | C3'I2 |
| C2O4 | C4'I2 |
| C3O1 | C1'I3 |
| C3O2 | C2'I3 |
| C3O3 | C3'I3 |
| C3O4 | C4'I3 |

TABLE 1-continued

| Terminal 1 | Terminal 2 |
|---|---|
| C4O1 | C1'I4 |
| C4O2 | C2'I4 |
| C4O3 | C3'I4 |
| C4O4 | C4'I4 |

One of a combination of a first phase shifter 301 and a second phase shifter 303, a combination of at least one of the plurality of crossover lines 305 and the second phase shifter 303, a combination of the first phase shifter 301 and at least one of the plurality of crossover lines 305, and at least one of the plurality of three-dimensional crossover lines 250 is coupled between the $j^{th}$ output end of the $i^{th}$ three-dimensional coupler 200 of the first coupler set 350 and the $i^{th}$ input end of the $j^{th}$ coupler of the second coupler set 370 of the three-dimensional Butler Matrix 300, wherein i and j are positive integers less than or equal to 4.

Specifically, the first phase shifters 301 are coupled to the first output ends c1O1 and c3O1 and the third output ends c1O3 and c3O3 of the first coupler c1 and the third coupler c3 of the first coupler set 350. In addition, the phase shifters 301 are also coupled to the second output ends c2O2 and c4O2 and the fourth output ends c2O4 and c4O4 of the second coupler c2 and the fourth coupler c4 of the first coupler set 350.

Besides, the second phase shifters 303 are coupled to the first input ends c1'I1 and c2'I1 and the second input ends c1'I2 and c2'I2 of the first coupler c1' and the second coupler c2' of the second coupler set 370. In addition, the second phase shifters 303 are also coupled to the third input ends c3'I3 and c413 and the fourth input ends c3'I4 and c4'I4 of the third coupler c3' and the fourth coupler c4' of the second coupler set 370.

In the embodiment, the first phase shifter 301 serves to control the horizontal direction of the beamformed signal, and the second phase shifter 303 serves to control the vertical direction of the beamformed signal. In the embodiment, the first phase shifter 301 and the second phase shifter 303 respectively have a phase difference of 45 degrees. However, the disclosure is not limited thereto. Locations of the first phase shifters 301 and the second shifters 303 are also interchangeable. For example, the second phase shifters 303 may be arranged at the locations where the first phase shifters 301 are originally located in the three-dimensional Butler Matrix 300, and the first phase shifters 301 may be arranged at the locations where the second phase shifters 303 are originally located in the three-dimensional Butler Matrix 300. The disclosure is not limited thereto.

Four crossover lines 305 are coupled between the first coupler set 350 and the second coupler set 370 of the three-dimensional Butler Matrix 300. The crossover lines 305 allow the output ends and the input ends of the respective three-dimensional couplers 200 to be coupled to each other. Table 2 lists combinations of terminals coupled to each other through the crossover lines 305.

TABLE 2

| | Terminals of three-dimensional couplers | |
|---|---|---|
| First set of crossover line 305 | c1O2 | c2'I1 |
| | c2O1 | c1'I2 |
| Second set of crossover line 305 | c2O4 | c4'I2 |
| | c4O2 | c2'I4 |

TABLE 2-continued

| | Terminals of three-dimensional couplers | |
|---|---|---|
| Third set of crossover line 305 | c3O4 | c4'I3 |
| | c4O3 | c3'I4 |
| Fourth set of crossover line 305 | c1O3 | c3'I1 |
| | c3O1 | c1'I3 |

Figure 3C:
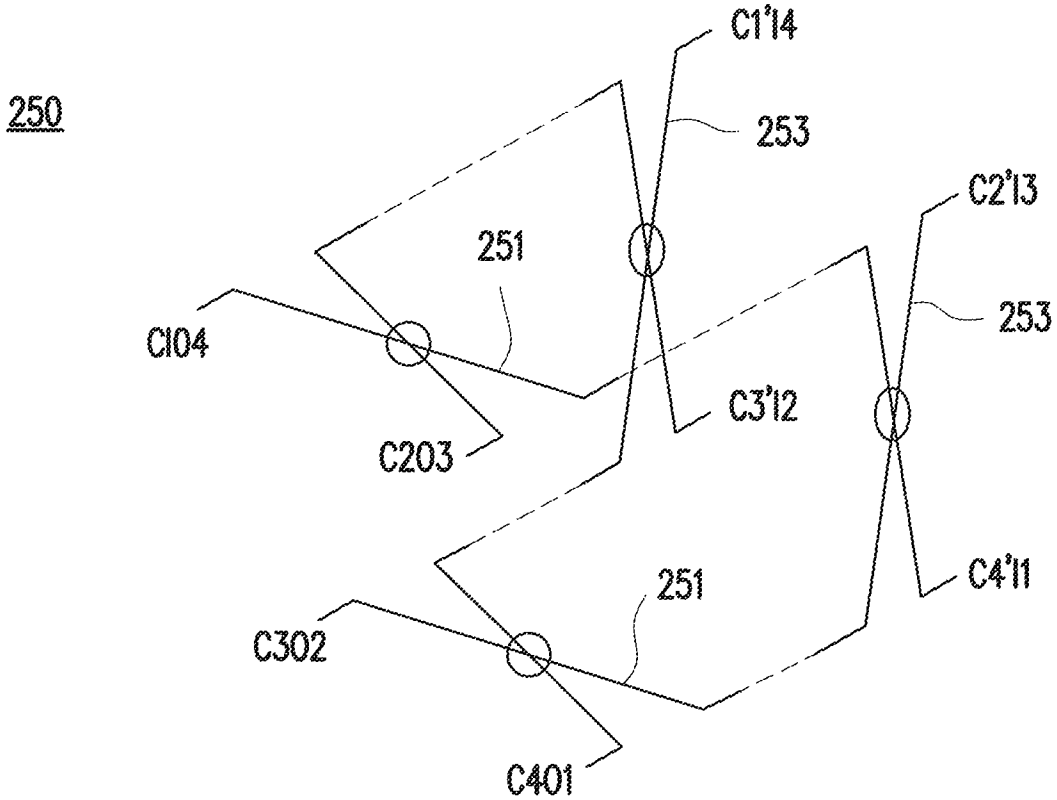
FIG. 3C is a schematic view illustrating a three-dimensional crossover line of the three-dimensional Butler Matrix of FIG. 3A.

FIG. 3C is a schematic view illustrating the three-dimensional crossover line 250 of the three-dimensional Butler Matrix 300 of FIG. 3A. In the embodiment, the third three-dimensional crossover line 250 is further coupled between the first coupler set 350 and the second coupler set 370 of the three-dimensional Butler Matrix 300. Details concerning connections of the three-dimensional crossover line 250 are shown in FIG. 3C. In the three-dimensional crossover line 250 shown in FIG. 3C, a $k^{th}$ input end and a $k^{th}$ output end are electrically connected with each other, and are respectively connected to a $(5-k)^{th}$ output end of a $k^{th}$ coupler in the first coupler set 350 and a $k^{th}$ input end of a $(5-k)^{th}$ coupler of the second coupler set 370, wherein k is a positive integer and less than or equal to 4.

Specifically, a first input end A and a first output end A' of the three-dimensional crossover line 250 are electrically connected with each other, and are respectively coupled to the fourth output end c1O4 of the first coupler c1 in the first coupler set 350 and the first input end c4'I1 of the fourth coupler c4' in the second coupler set 370.

A second input end B and a second output end B' of the three-dimensional crossover line 250 are electrically connected with each other, and are respectively coupled to the third output end c2O3 of the second coupler c2 in the first coupler set 350 and the second input end c3'I2 of the third coupler c3' in the second coupler set 370.

A third input end C and a third output end C' of the three-dimensional crossover line 250 are electrically connected with each other, and are respectively coupled to the second output end c3O2 of the third coupler c3 in the first coupler set 350 and the third input end c2'I3 of the second coupler c2' in the second coupler set 370.

A fourth input end D and a fourth output end D' of the three-dimensional crossover line 250 are electrically connected with each other, and are respectively coupled to the first output end c4O1 of the fourth coupler c4 in the first coupler set 350 and the fourth input end c1'I4 of the first coupler c1' in the second coupler set 370.

Four crossover lines 305 are coupled between the second coupler set 370 and the output array 330 of the three-dimensional Butler Matrix 300. The crossover lines 305 allow the output ends of the respective three-dimensional couplers 200 to be coupled with the output array 330. Table 3 lists combinations of terminals coupled to each other through the crossover lines 305.

TABLE 3

| | Terminals of three-dimensional couplers | Output ends of the output array |
|---|---|---|
| First set of crossover line 305 | c1'O2 | PO3 |
| | c2'O1 | PO2 |
| Second set of crossover line 305 | c2'O4 | PO12 |
| | c4'O2 | PO8 |

TABLE 3-continued

| | Terminals of three-dimensional couplers | Output ends of the output array |
|---|---|---|
| Third set of crossover line 305 | c3'O4 | PO15 |
| | c4'O3 | PO14 |
| Fourth set of crossover line 305 | c1'O3 | PO9 |
| | c3'O1 | PO5 |

Figure 3D:
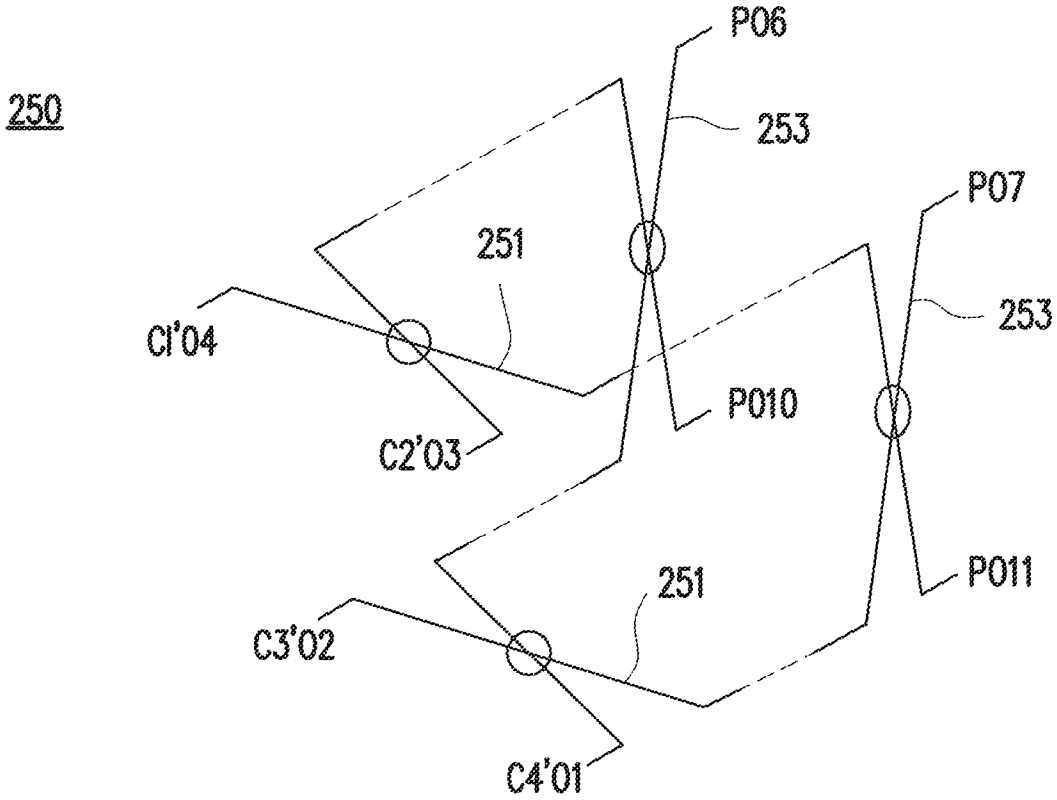
FIG. 3D is a schematic view illustrating an embodiment of another three-dimensional crossover line of the three-dimensional Butler Matrix shown in FIG. 3A.

FIG. 3D is a schematic view illustrating an embodiment of another three-dimensional crossover line 250 of the three-dimensional Butler Matrix 300 shown in FIG. 3A. In the embodiment, the third three-dimensional crossover line 250 is also coupled between the second coupler set 370 and the output array 330 of the three-dimensional Butler Matrix 300. Details concerning connection of the three-dimensional crossover line 250 are shown in FIG. 3D.

Specifically, the first input end A and the first output end A' of the three-dimensional crossover line 250 are electrically connected with each other, and are respectively coupled to the fourth output end c1'O4 of the first coupler c1' in the second coupler set 370 and the output end PO11 of the output array 330.

The second input end B and the second output end B' of the three-dimensional crossover line 250 are electrically connected with each other, and are respectively coupled to the third output end c2'O3 of the second coupler c2' in the second coupler set 370 and the output end PO10 of the output array 330.

The third input end C and the third output end C' of the three-dimensional crossover line 250 are electrically connected with each other, and are respectively coupled to the second output end c3'O2 of the third coupler c3' in the second coupler set 370 and the output end PO07 of the output array 330.

The fourth input end D and the fourth output end D' of the three-dimensional crossover line 250 are electrically connected with each other, and are respectively coupled to the first output end c4'O1 of the fourth coupler c4' in the second coupler set 370 and the output end PO06 of the output array 330.

Referring back to FIG. 2A, on the surface S3 and a surface S5 (the surface S5 is formed by I3, I4, O3, and O4) of each of the three-dimensional couplers 200 of the three-dimensional Butler Matrix 300, the phase difference θ between one of the input ends and one of the output ends on the diagonal of the third surface and the fifth surface correspondingly is in relation to horizontal control on the beamformed signal. On the surface S4 and a surface S6 (the surface S6 is formed by I1, I3, O1, and O3) of each of the three-dimensional couplers 200, the phase difference θ between one of the input ends and one of the output ends on the diagonal of the fourth surface and the sixth surface correspondingly is in relation to vertical control on the beamformed signal.

Figure 4:
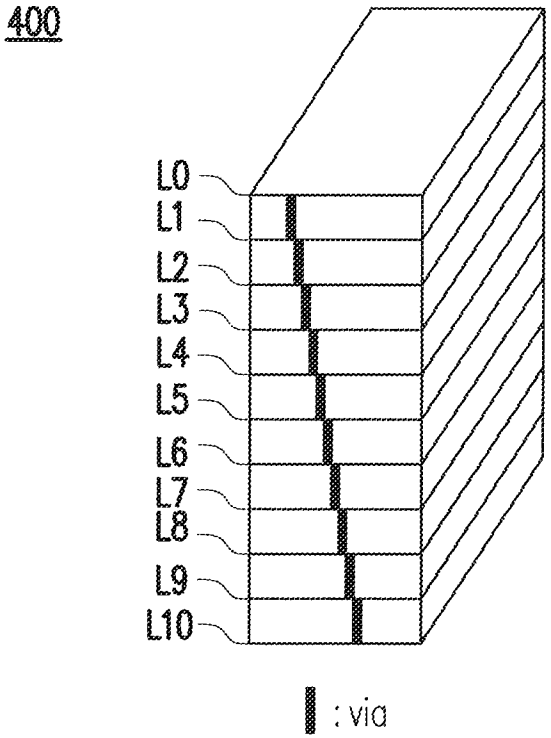
FIG. 4 is a schematic cross-sectional view illustrating a multi-layer circuit board implementing a three-dimensional Butler Matrix according to an embodiment of the disclosure.

FIG. 4 is a schematic cross-sectional view illustrating a multi-layer circuit board 400 implementing the three-dimensional Butler Matrix 300 according to an embodiment of the disclosure. The three-dimensional Butler Matrix 300 of the disclosure may be carried out by a single multi-layer circuit board 400, as shown in FIG. 4. The multi-layer circuit board 400 may be a circuit board with 11 layers. In addition, circuit layers L0 and L10 are respectively the output array 330 and the input array 310 of the three-dimensional Butler Matrix 300. Circuit layers L1, L3, L5, L7, and L9 are respectively grounding layers. Signals are transmitted between the respective circuit layers through vias.

Figure 5A:
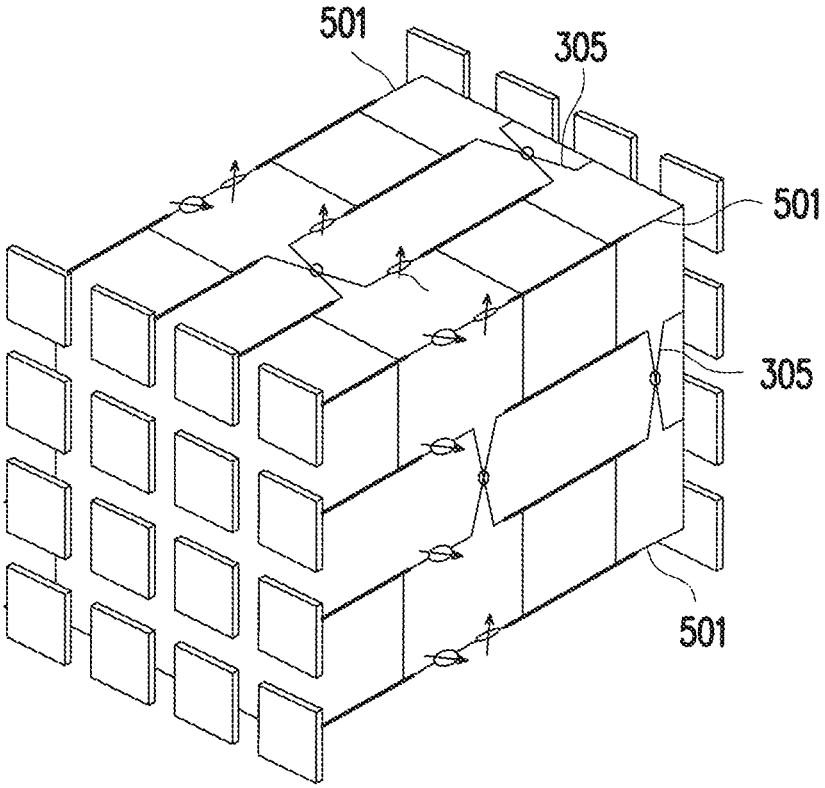
FIG. 5A is a circuit diagram illustrating a three-dimensional Butler Matrix according to an embodiment of the disclosure.
Figure 5B:
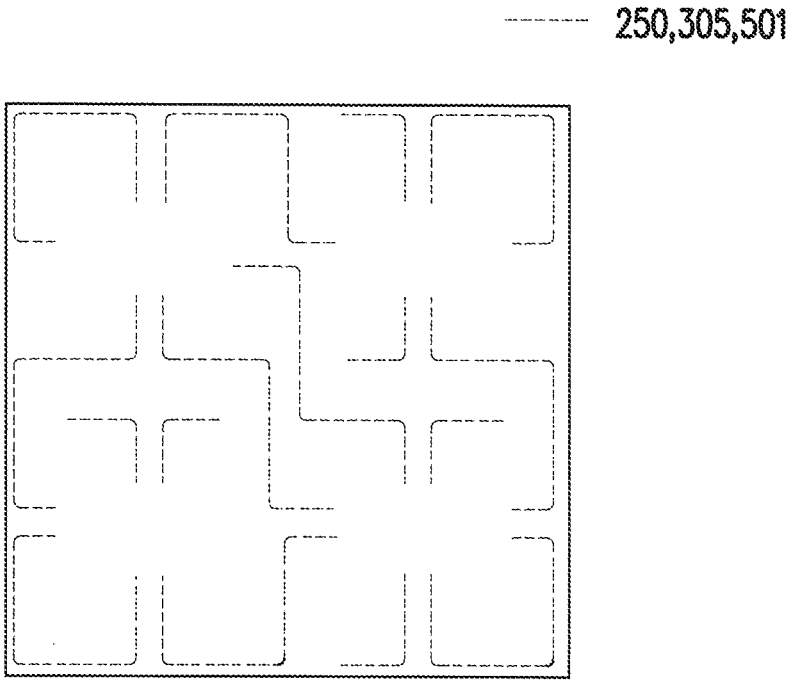
FIGS. 5B and 5C are layout diagrams of the multi-layer circuit board corresponding to the circuit diagram of FIG. 5A.
Figure 5C:
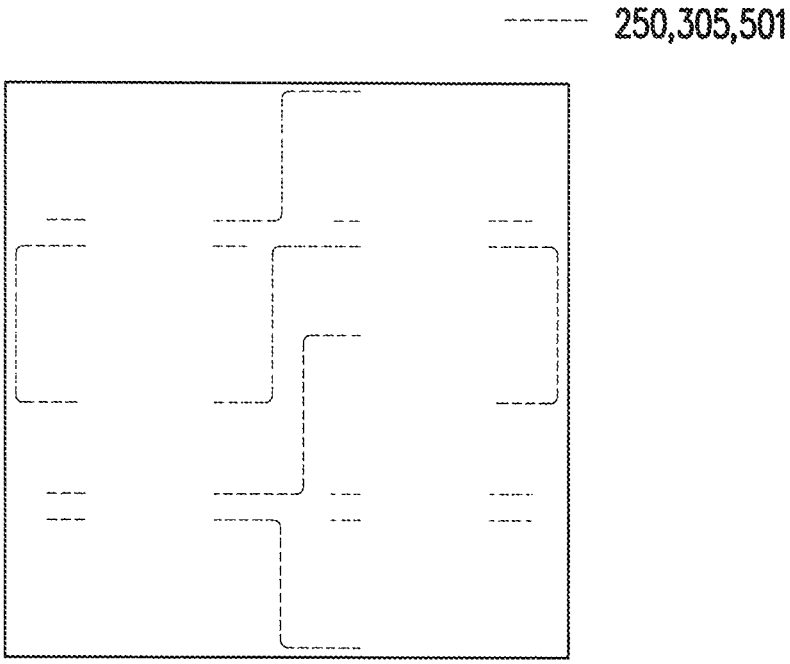

FIG. 5A is a circuit diagram illustrating the three-dimensional Butler Matrix 300 according to an embodiment of the disclosure. FIGS. 5B and 5C are layout diagrams of the multi-layer circuit board 400 corresponding to the circuit diagram of FIG. 5A. In addition, FIG. 5B is a layout diagram of a circuit layer L2, and FIG. 5C is a layout diagram of a circuit layer L4. The circuit layers L2 and L4 mainly include the three-dimensional crossover line 250 with connections shown in FIG. 3D, the crossover line 305 shown in FIG. 5A, and other wires 501 in the circuit board.

Figure 6A:
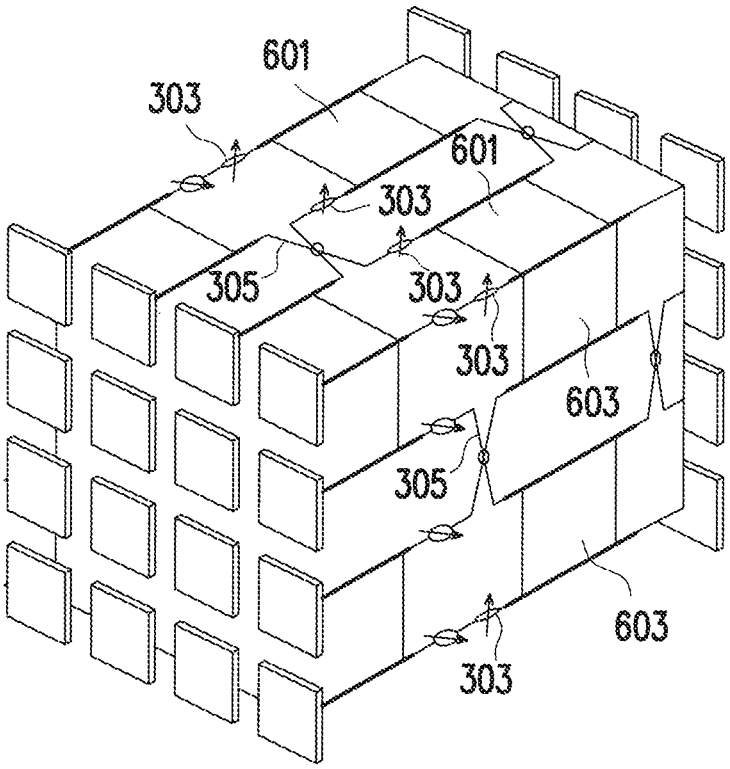
FIG. 6A is a circuit diagram illustrating a three-dimensional Butler Matrix according to an embodiment of the disclosure.
Figure 6B:
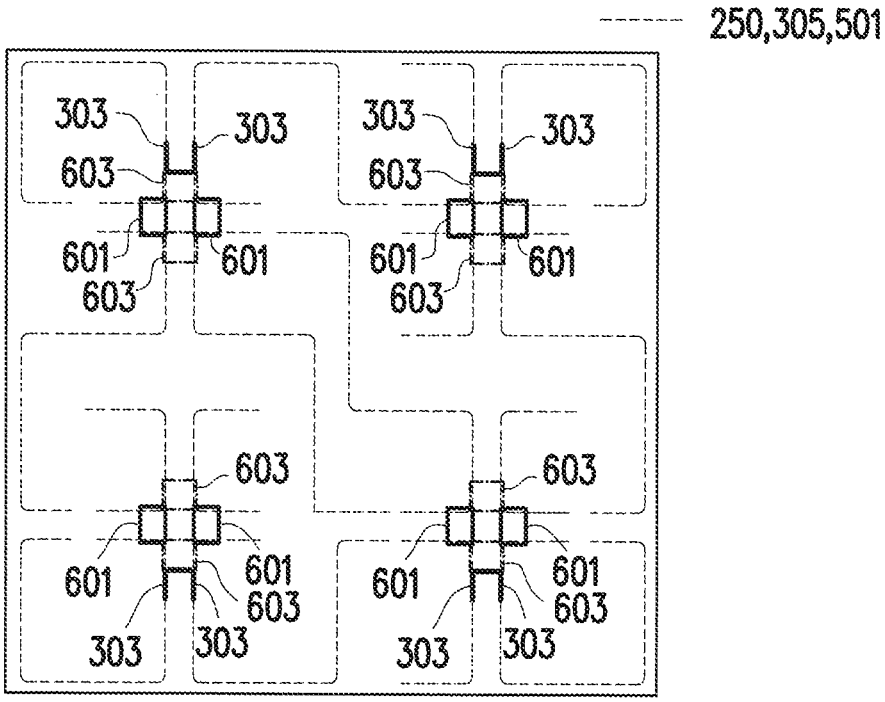
FIG. 6B is a layout diagram of the multi-layer circuit board corresponding to the circuit diagram of FIG. 6A.

FIG. 6A is a circuit diagram illustrating the three-dimensional Butler Matrix 300 according to an embodiment of the disclosure. FIG. 6B is a layout diagram of the multi-layer circuit board 400 corresponding to the circuit diagram of FIG. 6A. In addition, FIG. 6B is a layout diagram of the circuit layer L6. The circuit layer L6 mainly includes the three-dimensional crossover line 250 with the connections shown in FIG. 3C, the crossover line 305 shown in FIG. 6A, all the second phase shifters 303, the four three-dimensional couplers c1', c2', c3', and c4' in the second coupler set 370, and a quadrature coupler 601 relating to the horizontal control on the beamformed signal and a quadrature coupler 603 relating to the vertical control on the beamformed signal.

Figure 7A:
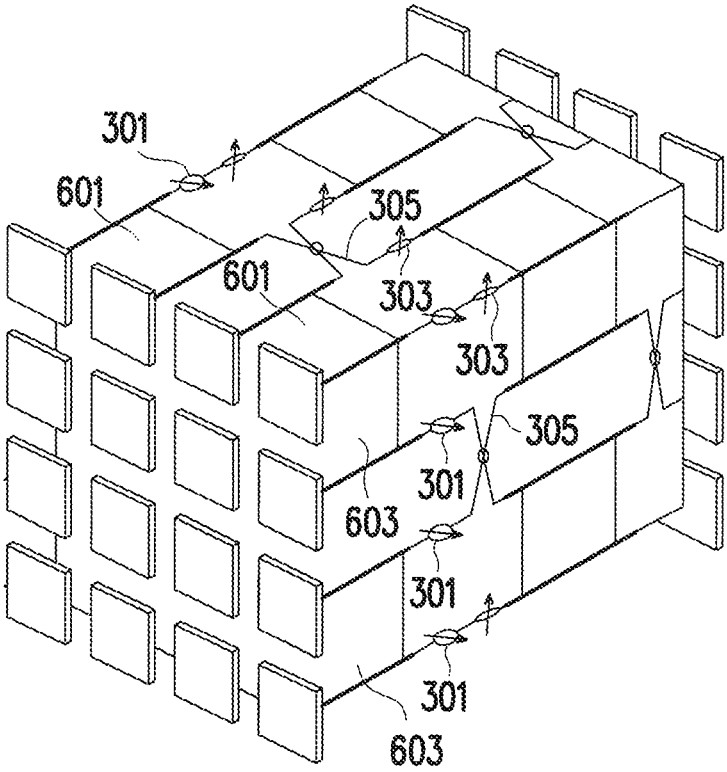
FIG. 7A is a circuit diagram illustrating a three-dimensional Butler Matrix according to an embodiment of the disclosure.
Figure 7B:
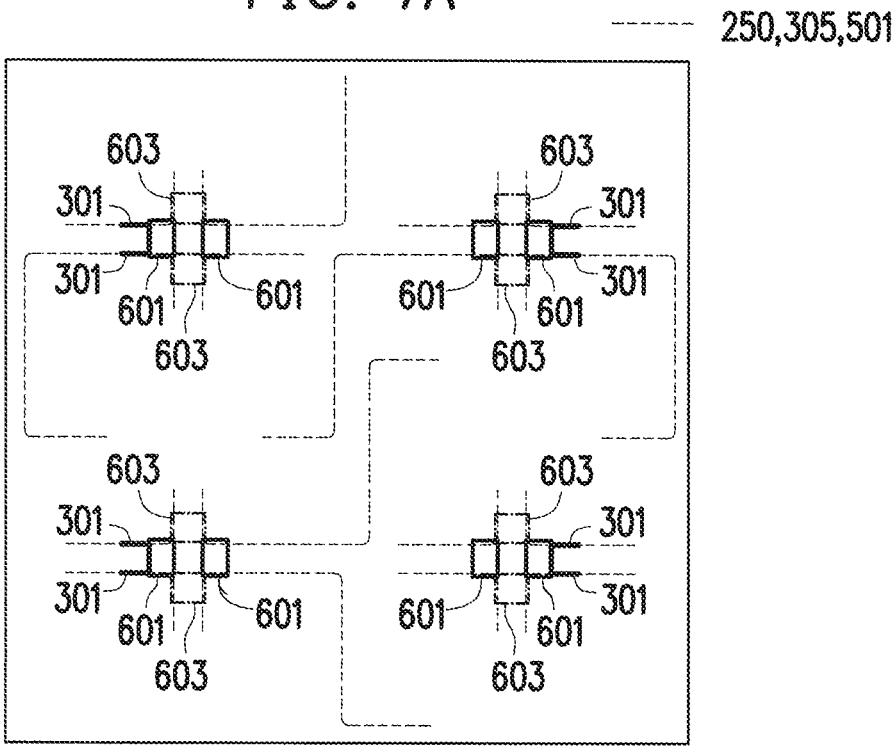
FIG. 7B is a layout diagram of the multi-layer circuit board corresponding to the circuit diagram of FIG. 7A.

FIG. 7A is a circuit diagram illustrating the three-dimensional Butler Matrix 300 according to an embodiment of the disclosure. FIG. 7B is a layout diagram of the multi-layer circuit board 400 corresponding to the circuit diagram of FIG. 7A. In addition, FIG. 7B is a layout diagram of a circuit layer L8. The circuit layer L8 mainly includes the three-dimensional crossover line 250 with the connections shown in FIG. 3C, the crossover line 305 shown in FIG. 7A, all the first phase shifters 301, the four three-dimensional couplers c1, c2, c3, and c4 in the first coupler set 350, the quadrature coupler 601 relating to the horizontal control on the beamformed signal and the quadrature coupler 603 relating to the vertical control on the beamformed signal, and other wires 501 in the circuit board.

Figure 8A:
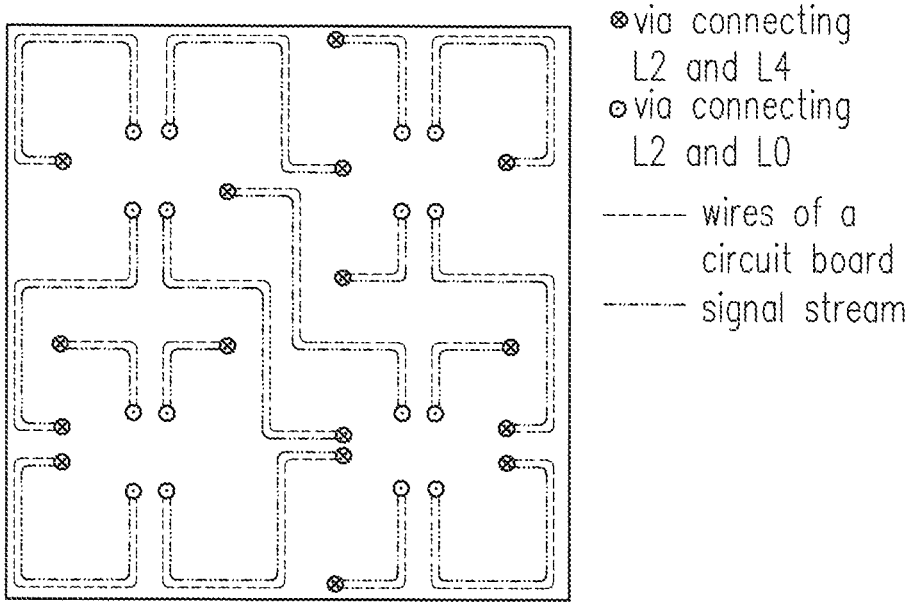
FIGS. 8A, 8B, 8C, and 8D are layout diagrams of a multi-layer circuit board according to an embodiment of the disclosure.
Figure 8B:
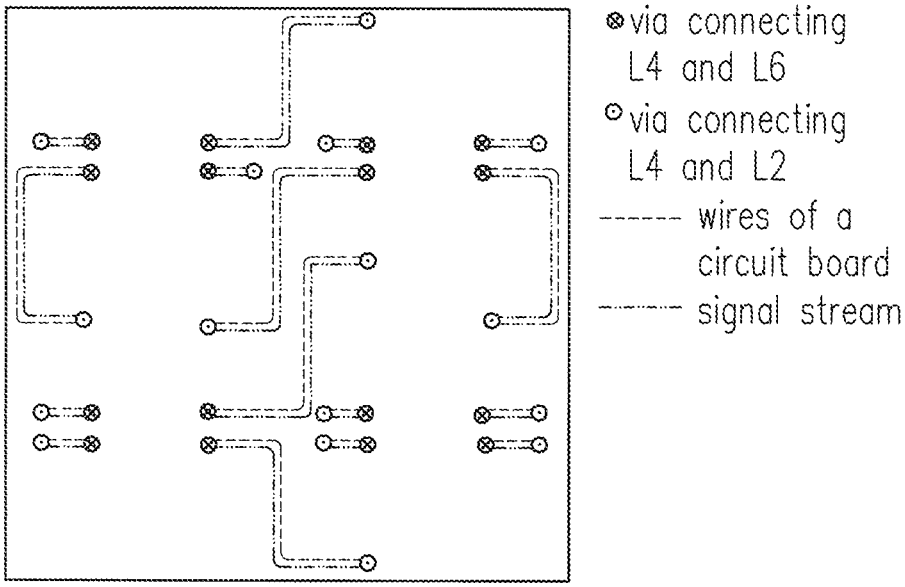
Figure 8C:
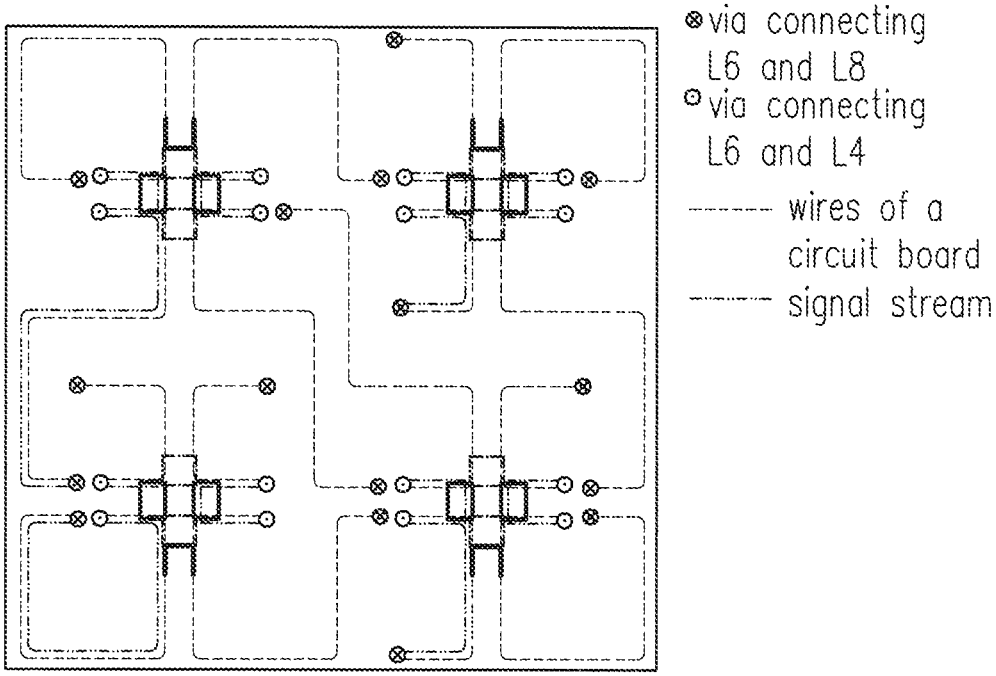
Figure 8D:
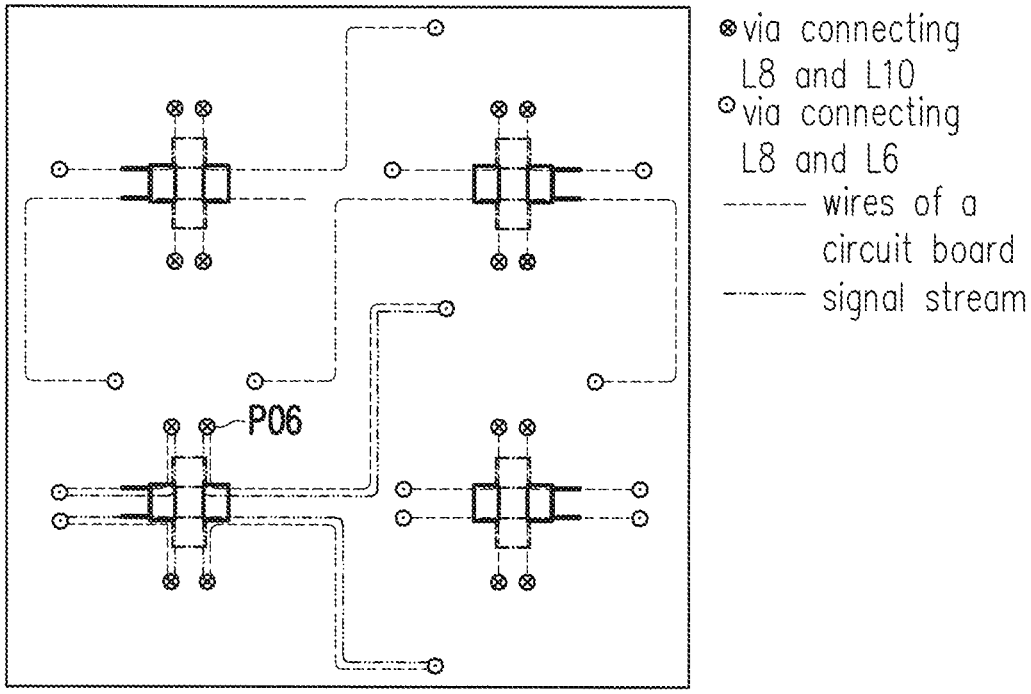

FIGS. 8A, 8B, 8C, and 8D are layout diagrams of the multi-layer circuit board 400 according to an embodiment of the disclosure. FIGS. 8A, 8B, 8C, and 8D illustrate signal transmission paths between the respective layers of the multi-layer circuit board 400 in greater detail. FIG. 8A illustrates a layout diagram of the circuit layer L2, and shows signal transmission paths between the circuit layers L2 and L4 and between the circuit layers L2 and L0. FIG. 8B illustrates a layout diagram of the circuit layer L4, and shows signal transmission paths between the circuit layers L4 and L2 and between the circuit layers L4 and L6. FIG. 8C illustrates a layout diagram of the circuit layer L6, and shows signal transmission paths between the circuit layers L6 and L4 and between the circuit layers L6 and L8. FIG. 8D illustrates a layout diagram of the circuit layer L8, and shows signal transmission paths between the circuit layers L8 and L6 and between the circuit layers L8 and L10.

Figure 9A:
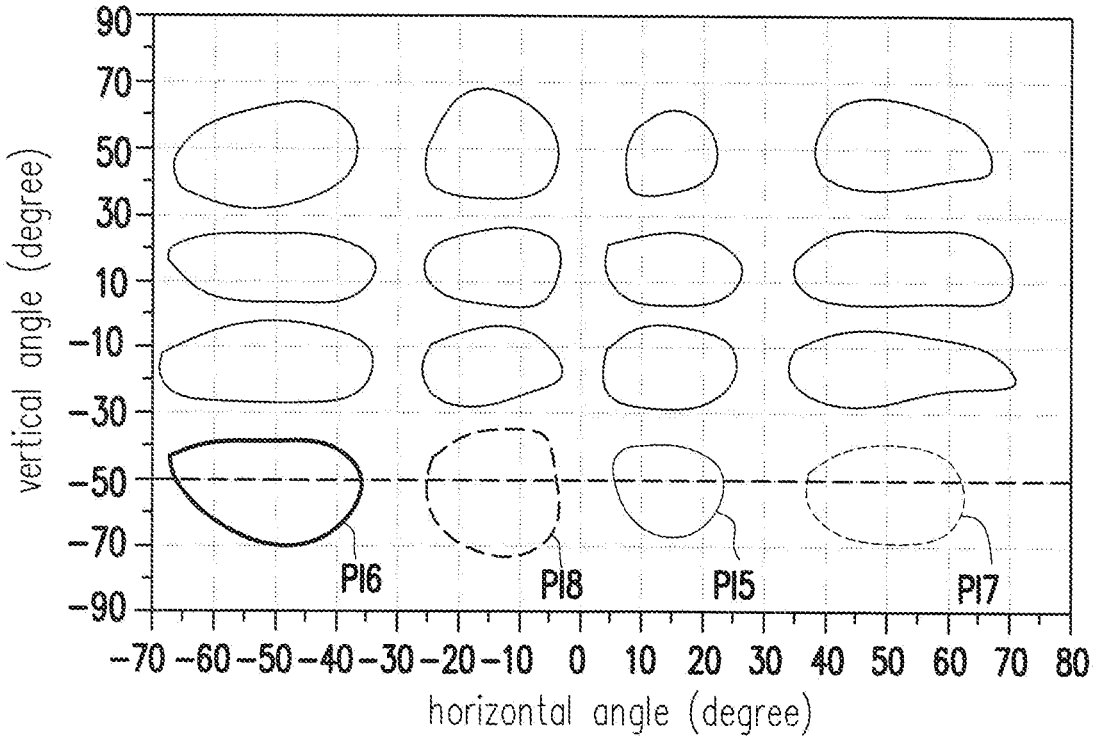
FIGS. 9A and 9B are schematic view illustrating a simulated channel performance of beamformed signals controlled by a three-dimensional Butler Matrix according to an embodiment of the disclosure.
Figure 9B:
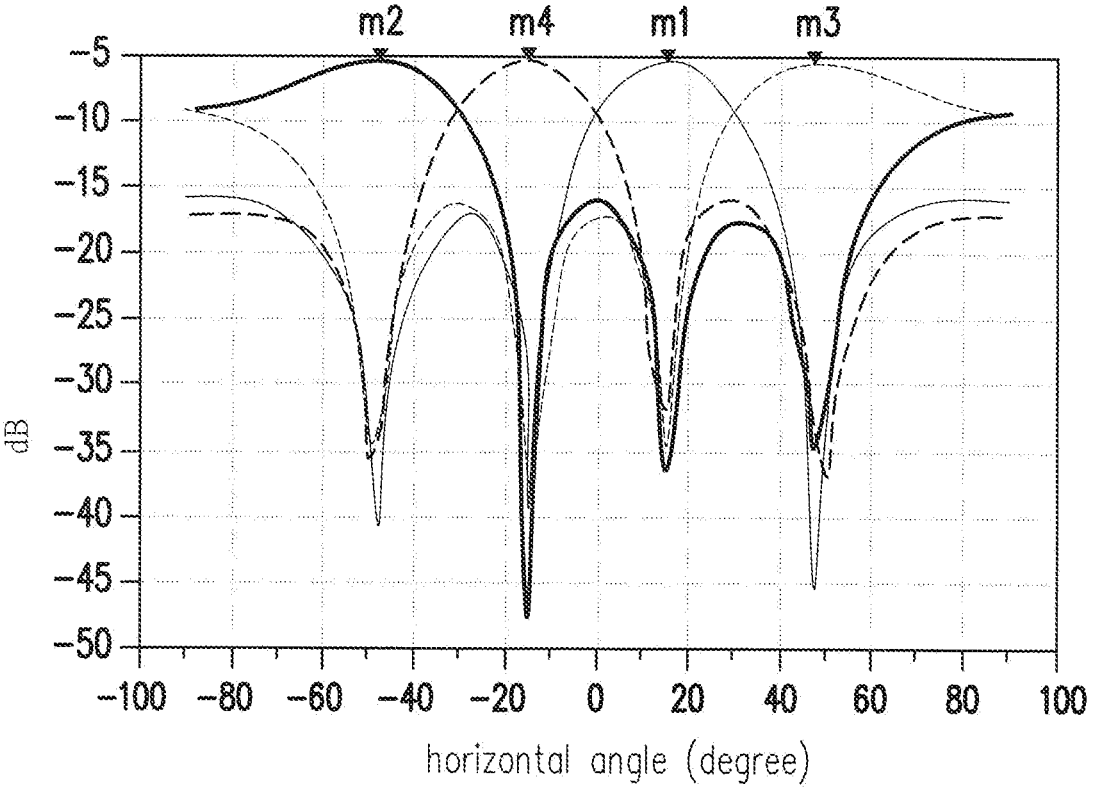

FIGS. 9A and 9B are schematic view illustrating a simulated channel performance of beamformed signals controlled by the three-dimensional Butler Matrix 300 according to an embodiment of the disclosure. Referring to FIGS. 9A and 9B, FIG. 9B shows channel performances of four beamformed signals generated by the three-dimensional Butler Matrix 300. Specifically, curves m1, m2, m3, and m4 in FIG. 9B respectively correspond to channel performances of beamformed signals generated from the input signals input from the input ends PI6, PI8, PI5, and PI7 of the input array 310. Since the input ends PI6, PI8, PI5, and PI7 are on the same row of the input array 310, vertical phase differences between the signals input from the input ends PI6, PI8, PI5, and PI7 and signals of any output end of each output array 330 are completely the same. Therefore, the beamformed signals represented by the curves m1, m2, m3, and m4 have the same emission angle in the vertical direction.

Taking the output ends PO1, PO2, PO3, and PO4 as an example, when a signal is input to the input end PI1, there is a horizontal phase difference of −45 degrees, for example, between the signals output from the output ends PO1, PO2, PO3, and PO4. However, there is no vertical phase difference between the signals output from the output ends PO1, PO2, PO3, and PO4. Similarly, when the signal is input to the input end PI2, there is a horizontal phase difference of +135 degrees, for example, between the signals output from the output ends PO1, PO2, PO3, and PO4. However, there is no vertical phase difference between the signals output from the output ends PO1, PO2, PO3, and PO4. Taking the output ends PO1, PO5, PO9, and PO13 as another example, when a signal is input to the input end PI1, there is a vertical phase difference of +45 degrees, for example, between the signals output from the output ends PO1, PO5, PO9, and PO13. However, there is no horizontal phase difference between the signals output from the output ends PO1, PO5, PO9, and PO13. Similarly, when there is a vertical phase difference of 45 degrees between the signals output by the output ends PO1, PO5, PO9, and PO13, when the signal is input to the input end PI5, there is a vertical phase difference of −135 degrees, for example, between the signals output from the output ends PO1, PO5, PO9, and PO13. However, there is no horizontal phase difference between the signals output from the output ends PO1, PO5, PO9, and PO13. Accordingly, when a signal is input from the input end PI1, the phase difference between the respective horizontally arranged output ends is different from the phase difference between the respective horizontally arranged output ends when the signal is input from the input end PI2. Besides, when inputting a signal from the input end PI1, the phase difference between the respective vertically arranged output ends is the same as the signal inputted from the input end PI2. Therefore, a beamformed signal obtained by inputting a signal from the input end PI6 and a beamformed signal obtained by inputting a signal from the input end PI8 have the same vertical angle but different horizontal angles, as shown in PI6 and PI8 of FIG. 9A.

In view of the foregoing, in addition to simultaneously controlling the horizontal direction and the vertical direction of the beam, the Butler Matrix of the disclosure can be manufactured with only a manufacturing process of a multilayer circuit board. Therefore, the size and the manufacturing cost of the Butler Matrix are able to be reduced significantly.

It will be clear to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A Butler Matrix, comprising:

a plurality of couplers, wherein each of the couplers has a circuit of a cuboid structure;

a plurality of crossover lines;

a plurality of three-dimensional crossover lines, wherein each of the three-dimensional crossover lines has a three-dimensional structure; and a plurality of phase shifters, wherein the crossover lines, the three-dimensional crossover lines, and the phase shifters are coupled between one of the couplers and another one of the couplers.

2. The Butler Matrix as claimed in claim 1, wherein each of the couplers comprises:

a plurality of input ends, comprising a first input end, a second input end, a third input end, and a fourth input end forming a first surface of the cuboid structure; and a plurality of output ends, comprising a first output end, a second output end, a third output end, and a fourth output end forming a second surface of the cuboid structure, wherein the first surface and the second surface of the cuboid structure do not intersect with each other.

3. The Butler Matrix as claimed in claim 2, further comprising:

a first coupler set, having at least four of the couplers; and a second coupler set, having at least four of the couplers, wherein first surfaces of the respective couplers in the first coupler set form an input array, and each side of the input array has the same number of input ends, second surfaces of the respective couplers in the second coupler set form an output array, and each side of the output array has the same number of output ends, and at least one of said input ends of at least one of the couplers in the first coupler set is coupled to the respective output ends of the respective couplers of the second coupler set.

4. The Butler Matrix as claimed in claim 3, wherein:

a $j^{th}$ output end of an $i^{th}$ coupler in the first coupler set is coupled to an $i^{th}$ input end of a $j^{th}$ coupler of the second coupler set, and i and j are positive integers, j is less than or equal to 4, i is less than or equal to N, and N is a positive integer that is a power of 4 or more.

5. The Butler Matrix as claimed in claim 4, wherein:

one of a combination of a first phase shifter and a second phase shifter, a combination of at least one of the plurality of crossover lines and the second phase shifter, a combination of the first phase shifter and at least one of the plurality of crossover lines, and at least one of the plurality of three-dimensional crossover lines is coupled between the $j^{th}$ output end of the $i^{th}$ coupler in the first coupler set and the $i^{th}$ input end of the $j^{th}$ coupler in the second coupler set.

6. The Butler Matrix as claimed in claim 4, wherein a first phase shifter is coupled to a first output end and a third output end of a first coupler and a third coupler in the first coupler set, and the first phase shifter is coupled to a second output end and a fourth output end of a second coupler and a fourth coupler in the first coupler set.

7. The Butler Matrix as claimed in claim 6, wherein a second phase shifter is coupled to a first input end and a second input end of a first coupler and a second coupler in the second coupler set, and the second phase shifter is coupled to a third input end and a fourth input end of a third coupler and a fourth coupler in the second coupler set.

8. The Butler Matrix as claimed in claim 7, wherein the first phase shifter is configured to control a horizontal direction of a beamformed signal, and the second phase shifter is configured to control a vertical direction of the beamformed signal.

9. The Butler Matrix as claimed in claim 8, wherein the first phase shifter and the second phase shifter respectively have a phase difference of +45 degrees, −45 degrees or −135 degrees.

10. The Butler Matrix as claimed in claim 2, wherein an $m^{th}$ input end of one of the plurality of couplers and an $m^{th}$ output end of the one of the plurality of couplers form a side of the cuboid structure, and m is a positive integer less than or equal to 4.

11. The Butler Matrix as claimed in claim 10, wherein a phase difference is provided between an input end and an output end on a diagonal of the same surface of the cuboid structure.

12. The Butler Matrix as claimed in claim 11, wherein the first input end, the second input end, the first output end, and the second output end of the one of the plurality of couplers form a third surface, the third input end, the fourth input end, the third output end, and the fourth output end of the one of the plurality of couplers form a fifth surface, and the phase difference between one of the input ends and one of the output ends on the diagonal of the third surface and the fifth surface correspondingly is in relation to control on a horizontal direction of a beamformed signal.

13. The Butler Matrix as claimed in claim 11, wherein the first input end, the third input end, the first output end, and the third output end of the one of the plurality of couplers form a fourth surface, the second input end, the fourth input end, the second output end, and the fourth output end of the one of the plurality of couplers form a sixth surface, and the phase difference between one of the input ends and one of the output ends on the diagonal of the fourth surface and the sixth surface correspondingly is in relation to control on a vertical direction of a beamformed signal.

14. The Butler Matrix as claimed in claim 11, wherein the phase difference is 90 degrees.

15. The Butler Matrix as claimed in claim 4, wherein:

a $k^{th}$ input end and a $k^{th}$ output end in one of the three-dimensional crossover lines are electrically connected with each other and are respectively coupled to a $(5-k)^{th}$ output end of a $k^{th}$ coupler in the first coupler set and a $k^{th}$ input end of a $(5-k)^{th}$ coupler in the second coupler set, and k is a positive integer less than or equal to 4.

16. The Butler Matrix as claimed in claim 4, wherein the output array is a four-by-four array, and a first input end and a first output end in one of the three-dimensional crossover lines are electrically connected with each other and are respectively coupled to a fourth output end of a first coupler in the second coupler set and an output end on a third column and a third row of the output array, a second input end and a second output end in the one of the three-dimensional crossover lines are electrically connected with each other and are respectively coupled to a third output end of a second coupler in the second coupler set and an output end on a second column and the third row of the output array, a third input end and a third output end in the one of the three-dimensional crossover lines are electrically connected with each other and are respectively coupled to a second output end of a third coupler in the second coupler set and an output end on the third column and a second row of the output array, and a fourth input end and a fourth output end in the one of the three-dimensional crossover lines are electrically connected with each other and are respectively coupled to a first output end of a fourth coupler in the second coupler set and an output end on the second column and the third row of the output array.

17. The Butler Matrix as claimed in claim 2, wherein said input ends of the couplers are insulated from each other, and said output ends of the couplers are insulated from each other.

* * * * *